US011665463B2

(12) United States Patent
Silva et al.

(10) Patent No.: US 11,665,463 B2
(45) Date of Patent: May 30, 2023

(54) WEARABLE AUDIO DEVICE WITH MODULAR BATTERY AND ELECTRONICS

(71) Applicant: Bose Corporation, Framingham, MA (US)

(72) Inventors: Mitchell Joseph Silva, Dorchester, MA (US); Joel Henry Miller, Westborough, MA (US); Louis Gwo-chung Chen, Bolton, MA (US); Naganagouda Patil, Westborough, MA (US); Kendra Jean Winn, Upton, MA (US); Maureen Margaret Brenner, Needham, MA (US)

(73) Assignee: Bose Corporation, Framingham, MA (US)

( * ) Notice: Subject to any disclaimer, the term of this patent is extended or adjusted under 35 U.S.C. 154(b) by 148 days.

(21) Appl. No.: 17/090,154

(22) Filed: Nov. 5, 2020

(65) Prior Publication Data

US 2021/0152921 A1 May 20, 2021

Related U.S. Application Data

(60) Provisional application No. 62/935,742, filed on Nov. 15, 2019.

(51) Int. Cl.
*H04R 25/00* (2006.01)
*H04R 1/10* (2006.01)

(52) U.S. Cl.
CPC ..... *H04R 1/1058* (2013.01); *H04R 1/1016* (2013.01); *H04R 1/1025* (2013.01); *H04R 1/1041* (2013.01)

(58) Field of Classification Search
CPC ..... H04R 25/602; H04R 1/62; H04R 1/1058; H04R 25/608; H04R 25/65; H04R 1/1091; H04R 1/1066; H04R 1/1016; H04R 1/1008
See application file for complete search history.

(56) References Cited

U.S. PATENT DOCUMENTS

2009/0285437 A1* 11/2009 Takigawa ..... H04R 1/1041 381/380
2014/0328492 A1* 11/2014 Feeley ..... H04R 25/60 381/74

* cited by examiner

*Primary Examiner* — Amir H Etesam
(74) *Attorney, Agent, or Firm* — Hoffman Warnick LLC

(57) ABSTRACT

Various aspects include wearable audio devices and related systems. In particular implementations, a wearable audio device includes: a base having: an acoustic transducer; a controller coupled with the acoustic transducer; and terminals for connecting a power source; and a first cap including: an antenna; and a battery including terminals for connecting with the terminals in the base, where the first cap is removably coupled to the base.

20 Claims, 11 Drawing Sheets

Theta / Degree vs. dBi

WEARABLE AUDIO DEVICE WITH MODULAR BATTERY AND ELECTRONICS

PRIORITY CLAIM

This application claims priority to U.S. Provisional Patent Application No. 62/935,742, filed on Nov. 15, 2019, which is hereby incorporated by reference in its entirety.

TECHNICAL FIELD

This disclosure generally relates to wearable audio devices. More particularly, the disclosure relates to wearable audio devices with modular battery and communications units.

BACKGROUND

Consumers continue to demand ever-smaller wearable audio devices. However, as these devices reduce in size, many technical challenges arise. For example, as wearable audio devices such as wireless headphones, earphones (e.g., earbuds) and other wireless body-worn audio devices reduce in size, battery life and wireless performance are impacted. These tradeoffs can present challenges for device designers.

SUMMARY

All examples and features mentioned below can be combined in any technically possible way.

Various implementations of the disclosure include wearable audio devices and related systems. Particular implementations of the disclosure include wearable audio devices with modular battery components and related storage and/or charging systems.

In particular aspects, a wearable audio device includes: a base having: an acoustic transducer; a controller coupled with the acoustic transducer; and terminals for connecting a power source; and a first cap including: an antenna; and a battery including terminals for connecting with the terminals in the base, where the first cap is removably coupled to the base.

In other particular aspects, a system includes: a wearable audio device including: a base having: an acoustic transducer; a controller coupled with the acoustic transducer; and terminals for connecting a power source; a first cap including: an antenna; and a battery having terminals for connecting with the terminals in the base, where the first cap is removably coupled to the base; at least one additional cap including: an antenna; and a battery having terminals for connecting with the terminals in the base, where the at least one additional cap is decoupled from the base, and where the base is configured to couple with only one of the first cap or one of the at least one additional cap at a time; and a storage case including at least one slot for the accommodating at least one of: the base and the first cap when coupled to one another, or the base and one of the at least one additional cap when coupled to one another.

Implementations may include one of the following features, or any combination thereof.

In certain aspects, the wearable audio device further includes: at least one additional cap including: an antenna; and a battery having terminals for connecting with the terminals in the base, where the at least one additional cap is decoupled from the base, and where the base is configured to couple with only one of the first cap or one of the at least one additional cap at a time.

In some cases, the battery in the at least one additional cap has an approximately equal capacity as the battery in the first cap, or a greater capacity than the battery in the first cap.

In particular implementations, the first cap and the at least one additional cap have distinct visual characteristics.

In certain cases, the first cap and the additional cap(s) are sized to fit in a storage case with the base, where the storage case includes: a first set of slots for accommodating the base while coupled with the first cap or the additional cap; and a second set of slots for accommodating the other of the first cap or the additional cap not coupled with the base.

In particular aspects, the at least one additional cap provides additional power to the wearable audio device while the first cap is not in use.

In certain implementations, the antenna in each of the first cap and the additional cap is located proximate an outermost surface of the first cap and the additional cap such that communications signals to and from the antenna are substantially unobstructed by the battery.

In some cases, the base and the first cap are removably coupled by at least one mating feature in addition to connections between the terminals in the base and the terminals in the first cap.

In particular aspects, the mating feature(s) include: a magnet, a male/female coupler, a force-fit coupler, a threaded coupler and/or a slot-loaded coupler.

In some implementations, the wearable audio device includes a set of earbuds, and each earbud includes the base and the first cap.

In certain cases, the base substantially envelops the first cap such that when coupled to form each earbud, an outer surface of the first cap extends beyond a distal end of the base by less than approximately 10-20 percent of a length of the base as measured from a proximal end of the base.

In particular implementations, the set of earbuds include a hearing assistance audio device, and the base in at least one of the earbuds includes a light for differentiating a left earbud from a right earbud in the set of earbuds.

In some aspects, the light is further configured to indicate a remaining life in the battery.

In particular cases, the first cap further includes additional electronics.

In certain implementations, the base and the first cap each include a set of electrical contacts for transmitting data between the additional electronics and the controller.

In some cases, the additional electronics include at least one of: a user interface, an environmental sensor, a motion/orientation sensor or a communications module.

In particular aspects, the user interface includes a tactile interface, the environmental sensor includes at least one of: a pressure sensor, a humidity sensor or an air quality sensor, the motion/orientation sensor includes at least one of: an inertial measurement unit or an optical sensor, and the communications module includes at least one of: a Bluetooth module, a Bluetooth Low Energy (BLE) module, a near-field magnetic induction (NFMI) module or a cellular module.

In certain implementations, the storage case includes a charging case having a power source for charging: the base coupled with the first cap or the additional cap; and the other of the first cap or the additional cap that is decoupled from the base.

In particular aspects, the wearable audio device includes a set of earbuds, and each earbud includes the base and the first cap, where the storage case includes a charging case and the at least one slot includes two slots for charging only the base and a coupled one of the first cap or an additional cap for each earbud.

In certain cases, the system further includes a supplemental charging case that is removably coupled with the charging case, the supplemental charging case having: at least one additional slot for charging a decoupled one of the first cap or the at least one additional cap; and an additional power storage device.

In some implementations, the storage case includes a tool for at least one of coupling or decoupling the first cap or the at least one additional cap with the base.

Two or more features described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

Figure 1:
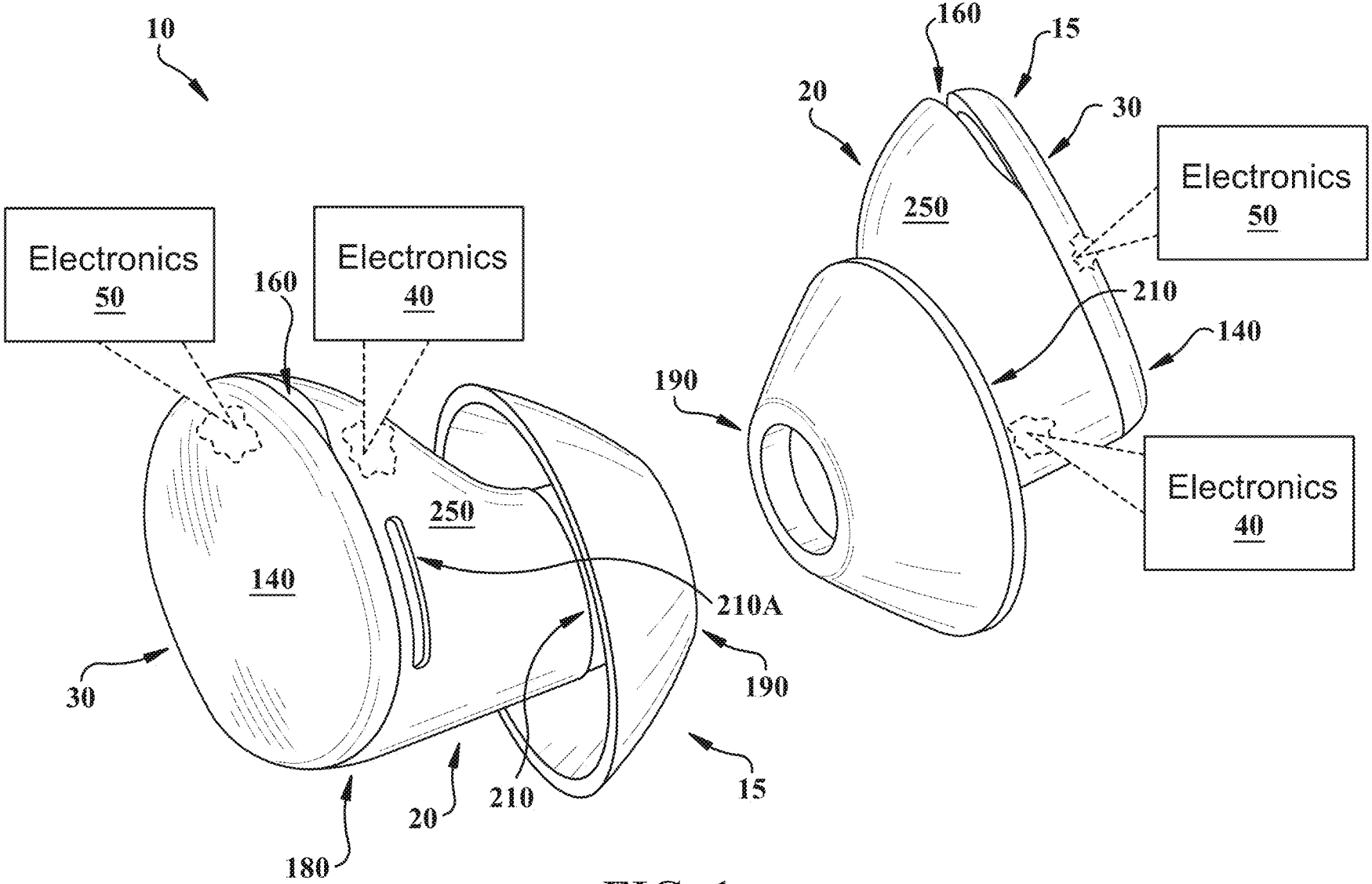
FIG. 1 shows a schematic depiction of an audio device according to various implementations.

It is noted that the drawings of the various implementations are not necessarily to scale. The drawings are intended to depict only typical aspects of the disclosure, and therefore should not be considered as limiting the scope of the invention. In the drawings, like numbering represents like elements between the drawings.

DETAILED DESCRIPTION

As noted herein, various aspects of the disclosure generally relate to wearable audio devices. More particularly, the disclosure relates to wearable audio devices with modular battery and communications units.

Commonly labeled components in the FIGURES are considered to be substantially equivalent components for the purposes of illustration, and redundant discussion of those components is omitted for clarity.

Aspects and implementations disclosed herein may be applicable to a wide variety of audio devices that can benefit from modular battery and communications units. Implementations disclosed herein can be applicable to wearable audio devices in various form factors, such as headphones (whether on or off ear), headsets, watches, eyeglasses, neck-worn speakers, shoulder-worn speakers, body-worn speakers, etc. Unless specified otherwise, the term wearable audio device, as used in this document, includes headphones and various other types of personal audio devices such as head, shoulder or body-worn acoustic devices that include one or more acoustic drivers to produce sound. Some particular aspects disclosed may be applicable to personal (wearable) audio devices such as in-ear headphones (also referred to as earbuds), eyeglasses or other head-mounted audio devices. Earbuds are described with particular detail in portions of the disclosure.

While described by way of example, wearable audio devices such as in-ear headphones (e.g., earbuds), audio accessories or clothing (e.g., audio hats, audio visors, audio jewelry, neck-worn speakers or audio eyeglasses (also referred to as eyeglass headphones) herein, the wearable audio devices disclosed herein can include additional features and capabilities. That is, the wearable audio devices described according to various implementations can include features found in one or more other wearable electronic devices, such as smart glasses, smart watches, etc. These wearable audio devices can include additional hardware components, such as one or more cameras, location tracking devices, microphones, etc., and may be capable of voice recognition, visual recognition, and other smart device functions. Additional capabilities of the wearable audio devices are described, for example, in U.S. patent application Ser. No. 16/179,205 (Spatialized Virtual Personal Assistant, filed on Nov. 2, 2018), which is herein incorporated by reference in its entirety. The description of wearable audio devices included herein is not intended to exclude these additional capabilities in such a device.

Various particular implementations include systems that can include wearable audio devices and related storage and/or charging cases. In certain implementations, a wearable audio device includes a base that has an acoustic transducer, a controller, and terminals for connecting a power source. The wearable audio device also has a cap that includes an antenna and a battery with terminals for connecting with the terminals in the base. The cap is removably coupled to the base, such that the cap can be replaced with an additional, removable cap. In various implementations, a system includes a storage case that has one or more slots for accommodating the base and removable cap(s). The storage case can be configured for charging the cap(s) in various implementations.

Figure 2:
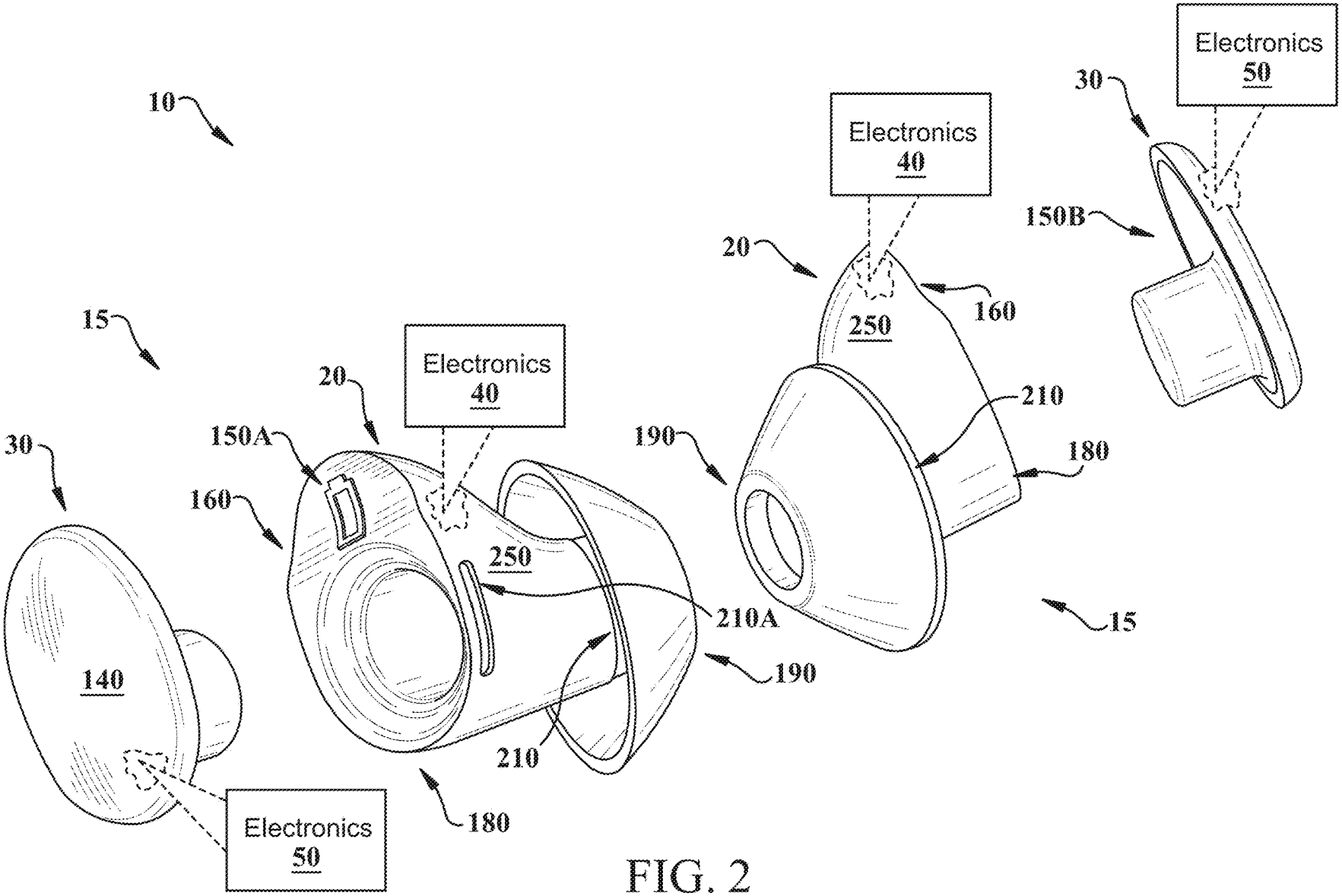
FIG. 2 shows a break-away view of portions of the audio device of FIG. 1.
Figure 3:
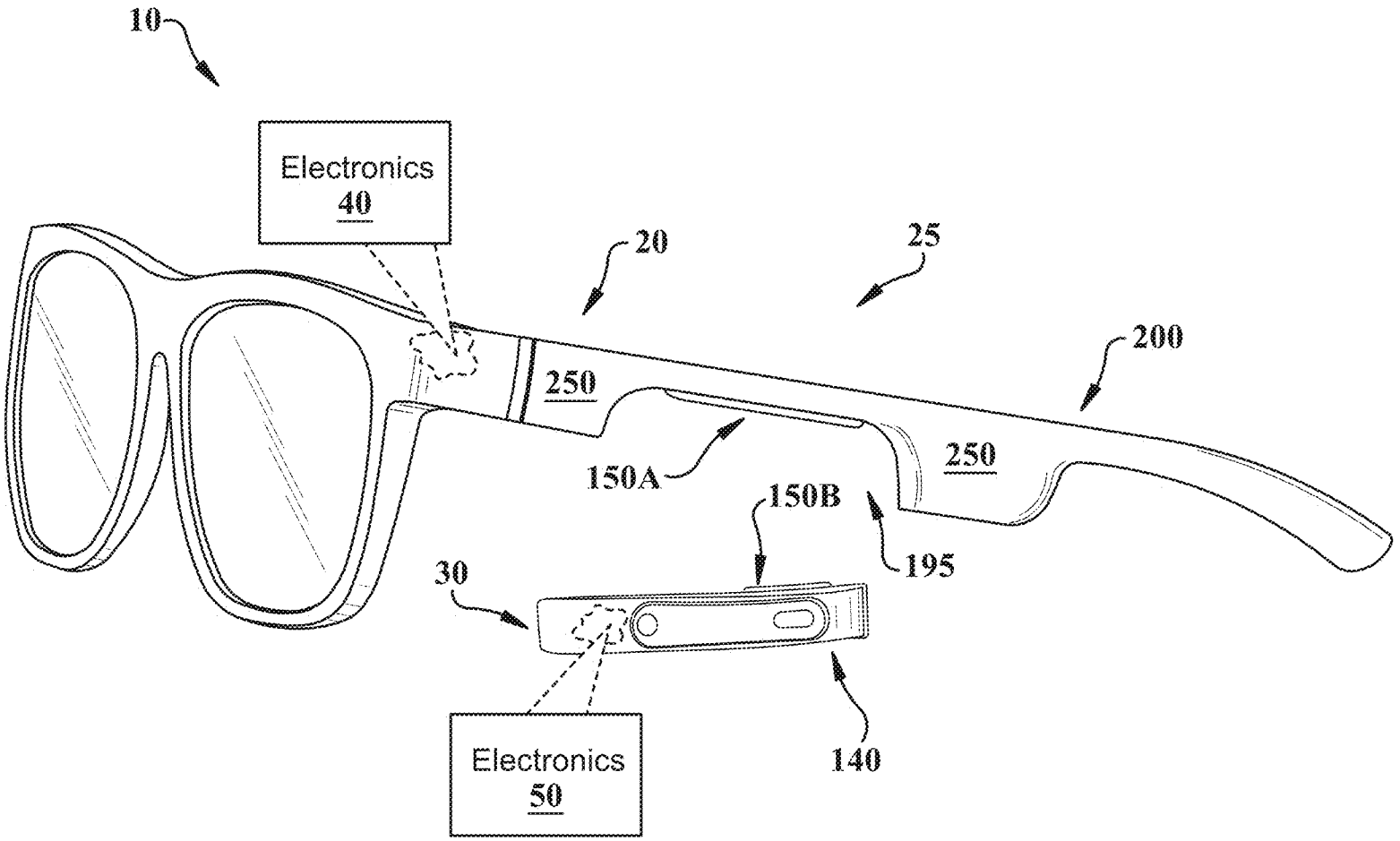
FIG. 3 shows a schematic depiction of an additional audio device according to various implementations.

FIGS. 1 and 2 are schematic perspective and break-away perspective views, respectively, of a wearable audio device 10 according to various implementations. In this example depiction, the wearable audio device 10 includes a set of (e.g., two) earbuds 15. In other implementations, the wearable audio device 10 can include any of the various wearable audio devices described herein, e.g., headphones, audio glasses, etc. For example, FIG. 3 illustrates an additional form factor for the audio device 10, including audio eyeglasses 25. Common components in the earbuds 15 in FIGS. 1 and 2, and the audio eyeglasses 25 in FIG. 3 are described collectively. While reference is made to the earbuds in FIGS. 1 and 2 in many circumstances, those descriptions can equally apply to similar components in the audio eyeglasses 25 in FIG. 3.

With reference to FIGS. 1-3, the wearable audio device 10 is shown including a base 20, and a first cap (or simply, cap) 30 for removably coupling with the base 20. FIG. 2 and FIG. 3 each depicts the cap 30 removed from the base 20. As noted herein, the cap 30 is capable of being decoupled from the base 20, and subsequently re-coupled or replaced with a distinct cap (e.g., a similar replacement cap or a distinct cap).

In certain implementations, the base 20 includes a set of electronics 40, and the cap 30 includes a distinct set of electronics 50. That is, electronics 40 in the base 20 are physically separated from electronics 50 in the cap 30. A schematic depiction of the electronics 40, 50 is included in FIG. 4. As shown, the electronics 40 in the base 20 can include at least one acoustic transducer 60, and a controller 70 coupled with the acoustic transducer(s) 60. The base 20 can also include terminals 80 for connecting the base 20 with a power source. The acoustic transducer 60 is configured to provide an audio output to the user, and may be configured for either closed-ear (e.g., in-ear or on-hear) or open-ear (or, near-ear) output.

The controller 70 can include various audio control components as well as device control components, e.g., hardware and/or software for performing functions described herein. For example, the controller 70 can include a processor (e.g., including a logic engine) to execute instructions for controlling device functions (e.g., to turn on or off functions in device 10, to start or stop audio playback, etc.), and may handle other device operations. In some cases, a memory is coupled with the processor to store the instructions. The memory at the device(s) can include, for example, flash memory and/or non-volatile random access memory (NVRAM). In some implementations, instructions (e.g., software such as a device detection application) are stored in an information carrier. The instructions, when executed by one or more processing devices, perform one or more processes to control device 10 functions. The instructions can also be stored by one or more storage devices, such as one or more (e.g. non-transitory) computer- or machine-readable mediums (for example, the memory, or memory on the processor). As described herein, the memory can include instructions, or the processor can otherwise access instructions for detecting connection with the cap 30 and taking a prescribed action according to various particular implementations. It is understood that portions of the memory (e.g., instructions) can also be stored in a remote location or in a distributed location, and can be fetched or otherwise obtained by the processor (e.g., via any communications protocol described herein) for execution.

In various implementations, the controller 70 also includes a radio and other audio control components. For example, the radio can include a radio-frequency (RF) transmitter for supporting wireless communication with external equipment. To support interactions with external equipment, the controller 70 can further include storage and processing circuitry used in implementing communications protocols. Communications protocols that may be implemented using storage and processing circuitry include wireless local area network protocols (e.g., IEEE 802.11 protocols—sometimes referred to as WiFi® and WiGig), protocols for other short-range wireless communications links such as the Bluetooth® protocol, cellular telephone protocols, etc.

The (first) cap 30 is shown having an antenna 90, and a battery 100 with terminals 110 for connecting with the terminals 80 in the base 20. The antenna 90 is configured to transmit and receive wireless signals. In certain implementations, the electronics 40 in the base 20 and the electronics 50 in the cap 30 are configured to communicate with a communications gateway 120, e.g., a smartphone, smart watch, or other audio playback device. As noted herein, the antenna 90 can enable certain communications between the communications gateway 120 and the audio device 10, e.g., communication with the controller 70 in the base 20.

In certain cases, the antenna 90 includes one or more metal traces (e.g., primary antenna trace and a ground trace) connected with a printed circuit. The antenna 90 can be configured to communicate wirelessly with external electronic equipment over a wireless communications link. The wireless communications link may be a cellular telephone link (e.g., a wireless link at frequencies of 700 MHz to 2700 MHz or other suitable cellular telephone frequencies), may be a wireless local area network link operating at 2.4 GHz, 5 GHz, or other suitable wireless local area network frequencies, may be a Bluetooth® link operating at 2.4 GHz, may involve millimeter wave communications, may involve near-field communications, or may involve wireless communications in other communications bands. Configurations in which device 10 operates at 2.4 GHz to support short-range communications such as Bluetooth® communications may sometimes be described herein as an example.

The antenna 90 can be formed using any suitable antenna type. For example, antenna 90 may be an antenna with a resonating element that is formed from a loop antenna structure, a patch antenna structure, an inverted-F antenna structure, a slot antenna structure, a planar inverted-F antenna structure, a helical antenna structure, a monopole, a dipole, hybrids of these designs, etc. If desired, antenna 90 may include tunable circuitry and controller 70 may be used to select a preferred setting for the tunable circuitry to tune antenna 90 when the cap 30 is connected with the base 20. Antenna adjustments may be made to tune antenna 90 to perform in a desired frequency range or to otherwise optimize antenna performance. Sensors may be incorporated into antenna 90 or elsewhere in device 10 to gather sensor data in real time that is used in adjusting antenna 90. Antenna 90 may also be implemented using a fixed (non-tunable) configuration. Example configurations of the antenna 90 are further described in U.S. patent application Ser. No. 16/389,240, entitled "Multi-Arm Spiral Antenna for a Wireless Device," filed on Apr. 19, 2019, which is herein incorporated by reference in its entirety.

Figure 4:
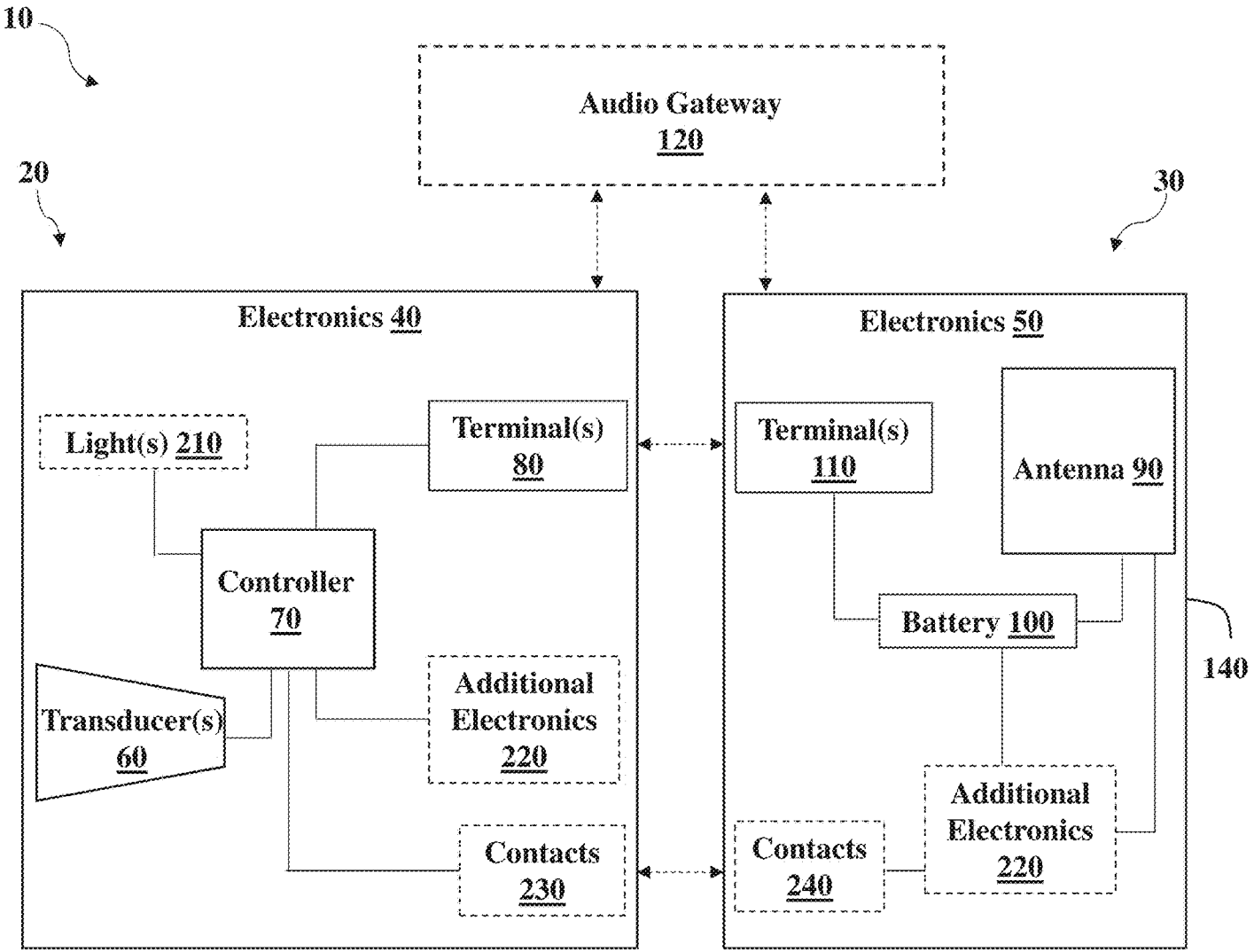
FIG. 4 is a system diagram illustrating electronics in components within an audio device according to various implementations.
Figure 5:
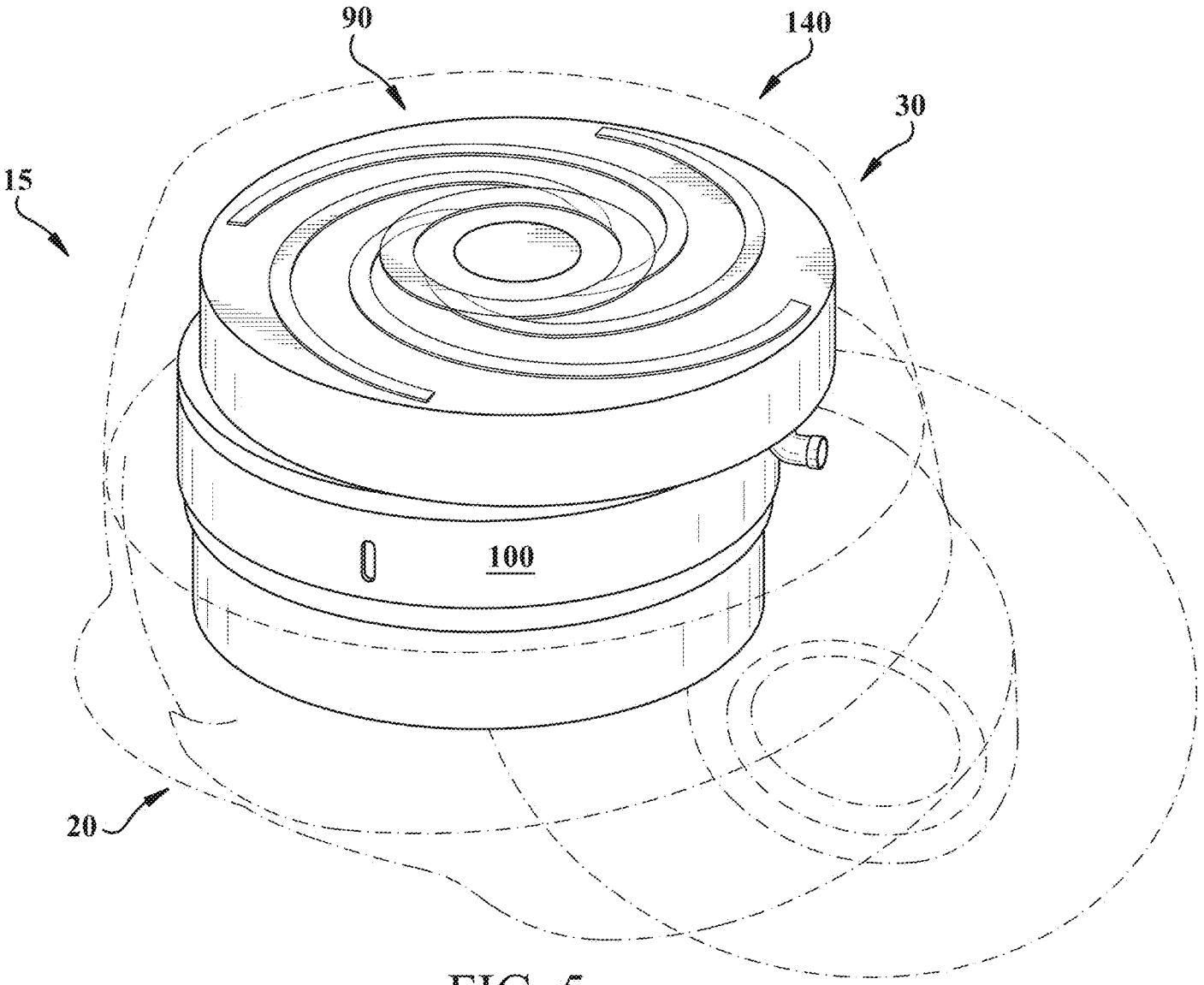
FIG. 5 is a schematic perspective view of an audio device according to various implementations.

An example depiction of an antenna 90 over a battery 100 in a cap 30 is illustrated in FIG. 5. In this example, the antenna 90 has a plurality of traces 130 proximate to (e.g., on or just below) an outermost surface 140 of the cap 30. That is, as illustrated in FIGS. 4 and 5, the antenna 90 can be located proximate the outermost surface 140 of the cap 30. In these cases, the antenna 90 is located closer to the outermost surface 140 of the cap 30 than the battery 100, such that signals to and from the antenna 90 are substantially unobstructed by the battery 100. That is, when worn by a user, the antenna 90 is located outboard of the battery 100 in order to minimize interference with signals to and from the antenna 90.

Figure 6:
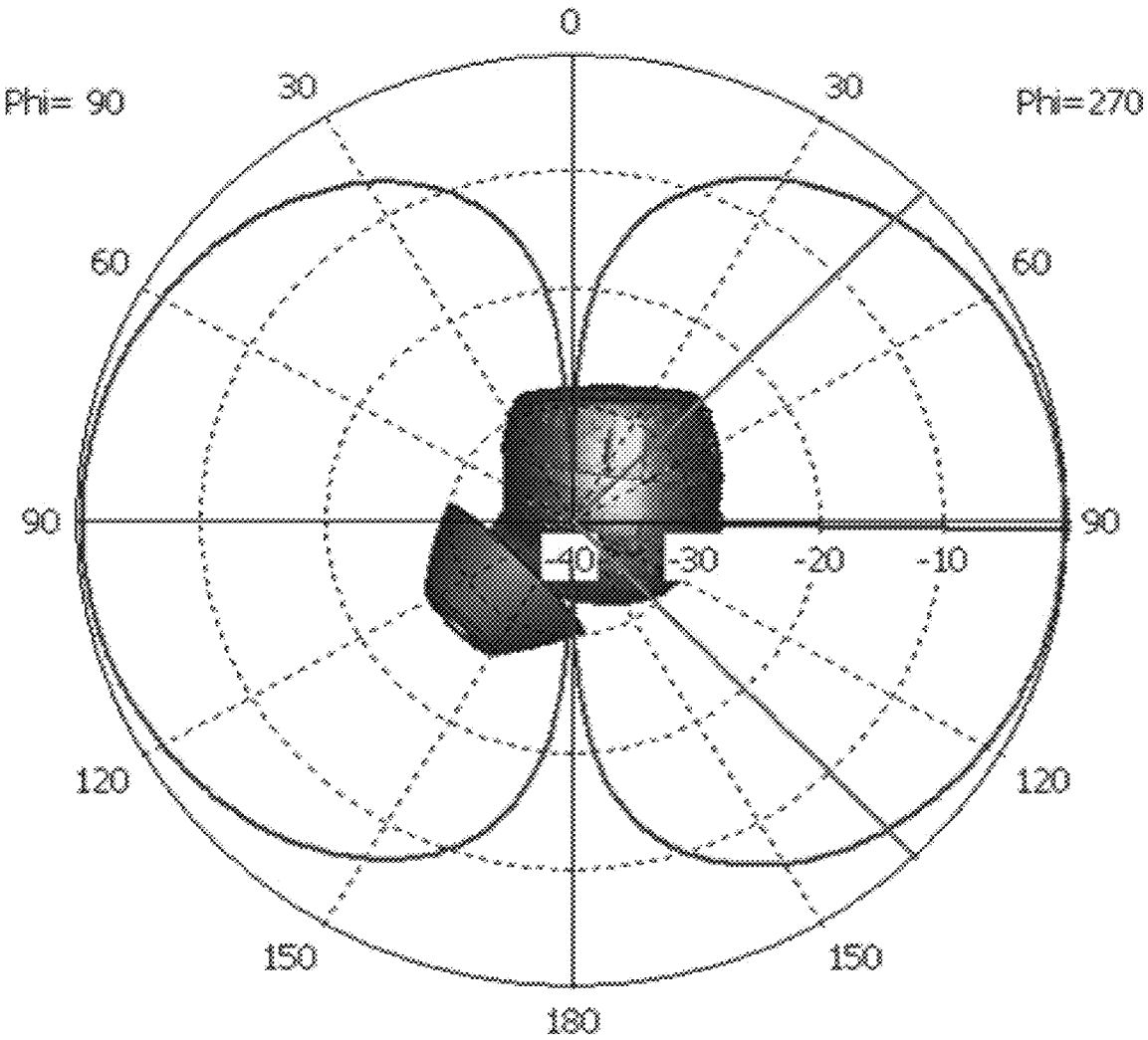
FIG. 6 shows a first polar plot of the radiation pattern from an antenna on an audio device according to various implementations.
Figure 7:
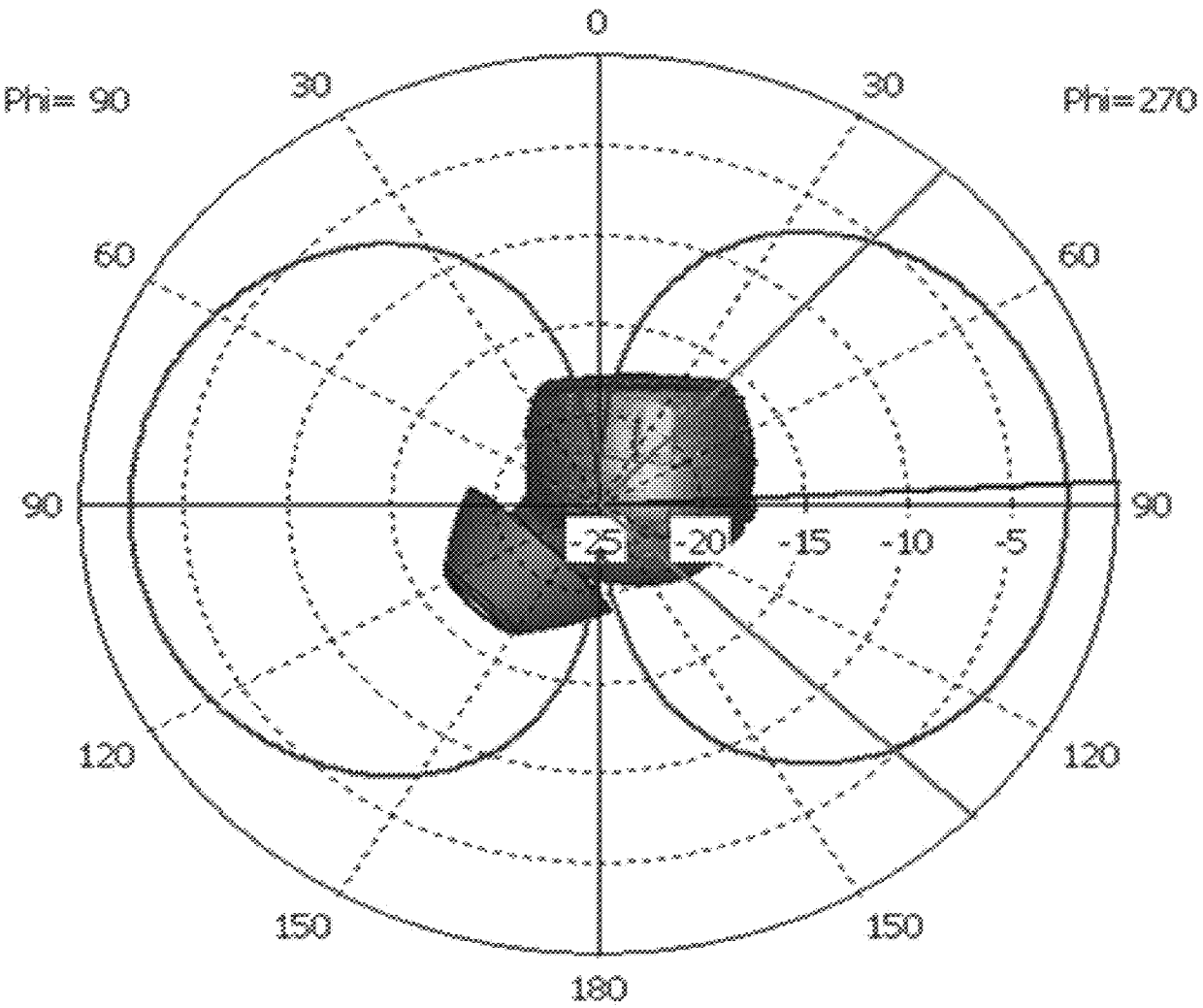
FIG. 7 shows a second polar plot of the radiation pattern from the antenna on an audio device according to various implementations.

FIGS. 6 and 7 are polar plots illustrating the vertical and horizontal polarization patterns, respectively, of the example antenna 90 in FIG. 5. Despite the close proximity of the battery 100 to the antenna 90, the radiation behavior of the antenna 90 is only minimally affected by the presence of the battery 100.

Figure 8:
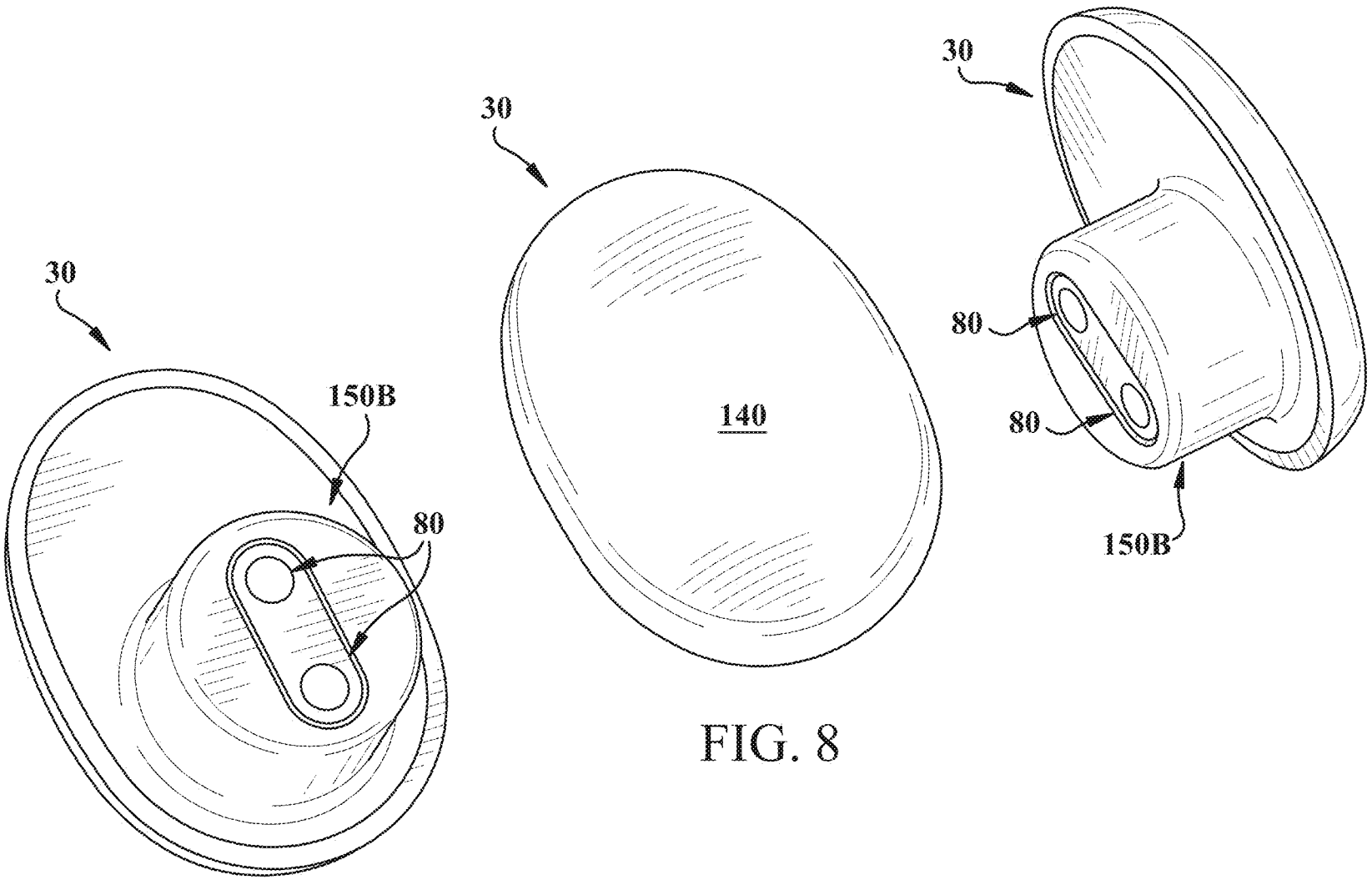
FIG. 8 shows distinct perspective views of a cap for an audio device according to various implementations.

FIG. 8 shows three distinct views of the cap 30 separated from the base 20 (FIG. 1, FIG. 2) in the earbud configuration. Only the cap 30 is illustrated in FIG. 8. As shown in FIGS. 1-3 and 8, the base 20 and the cap 30 include at least one mating feature 150 in addition to connections between the terminals 80 in the base 20 and the terminals 110 in the cap 30. In various implementations, the base 20 includes a first mating feature 150A (FIG. 2, FIG. 3), and the cap 30 includes a second, complementary mating feature 150B (FIGS. 2, 3 and 8). The mating features 150 are configured to physically retain the cap 30 on the base 20 when engaged. In certain implementations, the mating feature(s) 150 include at least one of: a magnet, a male/female coupler, a force-fit coupler, a threaded coupler or a slot-loaded coupler. In particular implementations, as illustrated in FIG. 1 and FIG. 2, the audio device 10 has a decoupling feature 160 for separating the cap 30 from the base 20. In certain implementations, the decoupling feature 160 includes a slot or recess enabling a user to separate the cap 30 from the base 20, e.g., by inserting a fingernail in the slot or gripping the cap 30.

In particular implementations, as illustrated in FIG. 1 and FIG. 2, the base 20 can substantially envelop the cap 30 such that when coupled to form the audio device 10 (e.g., earbud 15), the outer surface 140 of the cap 30 extends beyond a distal end 180 of the base 20 by less than approximately 10-20 percent of a length of the base 20 (as measured from a proximal end 190 of the base 20). Additionally, the base 20 can envelop the cap 30 in one or more additional directions that are perpendicular to the length of the base 20. For example, the base 20 can envelop the cap 30 in such a way that the outer surface 140 of the cap 30 does not extend beyond the outer surface 250 of the base 20 in a direction perpendicular to the length of the base 20, or only nominally extends beyond the outer surface 250 of the base 20 in those perpendicular directions. In this sense, the cap 30 mates to the existing footprint of the base 20 in these directions that are perpendicular to the length of the base 20. FIG. 3 illustrates the audio device 10 in the form of audio eyeglasses 25, where the cap 30 fits in a slot 195 in the base 20. Similarly to the earbud form in FIGS. 1 and 2, when coupled with the base 20, the cap 30 extends beyond the outer perimeter of the eyeglass arm 200 by less than approximately 10-20 percent of a thickness of the eyeglass arm 200.

In additional implementations, the audio device 10 is a hearing assistance audio device, such as a hearing aid. In these cases, as illustrated in FIGS. 1, 2 and 4, the base 20 can include at least one light 210 for differentiating a left earpiece from a right earpiece, e.g., differentiating the left earbud from the right earbud. In certain implementations, one base 20 has a light 210 for indicating that an earpiece is a left or right earpiece. In other implementations, both bases 20 have a light 210 for indicating a difference between left and right earpieces, e.g., with distinct colors for left and right earpieces. In still further implementations, the audio device 10 can include an additional light 210A for indicating a remaining life in the battery 100. In these cases, the additional light 210A can be located on the base 20 in a position that is visible from the outer ear of the user. In some cases, the additional light 210A is only engaged (e.g., lit) when the remaining life in the battery 100 reaches a threshold (e.g., 20% remaining or below).

In certain implementations, the base 20 and/or the cap 30 can include additional electronics 220 (FIG. 4). In various particular cases, the base 20 includes additional electronics 220 such as a user interface (UI), an environmental sensor, a motion/orientation sensor and/or a communications module. According to some examples, all of the additional electronics 220 are contained in the base 20. In these example implementations, the controller 70 is connected with the additional electronics 220 (e.g., via hard-wired and/or wireless means). Additional electronics 220 are illustrated in phantom as contained within the base 20 to reflect this optional implementation.

In still further implementations, the cap 30 contains one or more components in the additional electronics 220 (illustrated in phantom in this optional implementation). That is, the cap 30 that houses the battery 100 and the antenna 90 can also include additional electronics 220 for performing various functions described herein. In the case that the cap 30 includes additional electronics 220, the base 20 and the cap 30 can include a set of electrical contacts 230, 240, respectively for transmitting data between the additional electronics 220 in the cap 30 and the controller 70 in the base 20. In various implementations, the electrical contacts 230, 240 are located on a same side of each of the base 20 and cap 30 as the terminals 80, 110. That is, the electrical contacts 230 are located on sides of the base 20 and cap 30, respectively, such that when the cap 30 is mounted to the base 20, the electrical contacts 230 contact one another and are obstructed from view by the user.

In particular implementations, the UI includes a tactile interface such as a capacitive touch interface or other touch-based interface for receiving user commands, e.g., tap, double-tap, tap-and-hold, swipe, etc. In the example depictions in FIGS. 1-3, the UI can be located along the outer surface 250 of the base 20 that is exposed when the cap 30 is coupled to the base 20. That is, the UI is located along the outer surface 250 that is accessible to the user's touch when the cap 30 is coupled to the base 20. In other cases, where a portion of the UI is located in the cap 30, the UI can be located along the outermost surface 140 of the cap 30.

In certain cases, the environmental sensor includes a pressure sensor, a humidity sensor and/or an air quality sensor. In various implementations, two or more environmental sensors are combined in the same sensor housing within the additional electronics 220. In some cases, environmental sensor(s) can be located outboard of the battery 100 when located in the cap 30.

In some cases, the motion/orientation sensor includes an inertial measurement unit (IMU) and/or an optical sensor. In various implementations, the motion/orientation sensor is configured to detect motion of the audio device 10 and/or changes in orientation of the audio device 10 in order to enable device functions. In the case that the motion/orientation sensor includes an IMU, the IMU can include a microelectromechanical system (MEMS) device that combines a multi-axis accelerometer, gyroscope, and/or magnetometer. Example optical sensors can include a camera or light-based sensor.

In additional aspects, the communications module includes one or more of: a) a Bluetooth module, a Bluetooth Low Energy (BLE) module, a near-field magnetic induction (NFMI) module or a cellular module. In various implementations, the communications module is configured to communicate with other components in the audio device 10, e.g., communicate between headphones such as the two earbuds 15 shown in FIG. 1. Additionally, or alternatively, the communications module is configured to communicate with other devices, e.g., the communications gateway 120 (FIG. 4). As noted herein, one or more communications modules can be located in the base 20 and/or the cap 30. In particular examples, a BLE module, Bluetooth module and/or NFMI module can be located in the cap 30 in various configurations. In certain cases, location of communication modules between the base 20 and cap 30 is dictated by the footprint of those modules.

In particular cases, as noted herein, one or more additional electronics 220 are located in the cap 30, and in some cases, the modular configuration of the cap 30 enables distinct caps with distinct sets of additional electronics 220 therein. In certain cases, e.g., where particular additional electronics 220 are located in the cap 30, the audio device 10 can include one or more additional terminal connections (e.g., such as terminals 80, 110) and/or one or more additional contacts (e.g., electrical contacts 230, 240) for accommodating communications protocols such as those described herein.

In one example implementation, the environmental sensor is located in the cap 30, and can be part of an modular configuration for use in areas where environmental sensitivity is high, e.g., areas where air quality is sub-optimal and subject to significant changes. In these cases, the user can connect a version of the cap 30 with additional electronics 220 that include an environmental sensor for use in these areas. In still other cases, the motion/orientation sensor can enable particular device functions such as augmented reality (AR) audio functions, and when located in the cap 30, can provide a modular configuration where the user can substitute a cap 30 that does not include a motion/orientation sensor for a cap 30 that includes a motion/orientation sensor for enabling AR audio functions. In some cases, the controller 70 in the base 20 is configured to detect the presence of one or more additional electronics 220 in the cap 30 and enable functions in the audio device 10 based upon the detected additional electronics 220.

Figure 9:
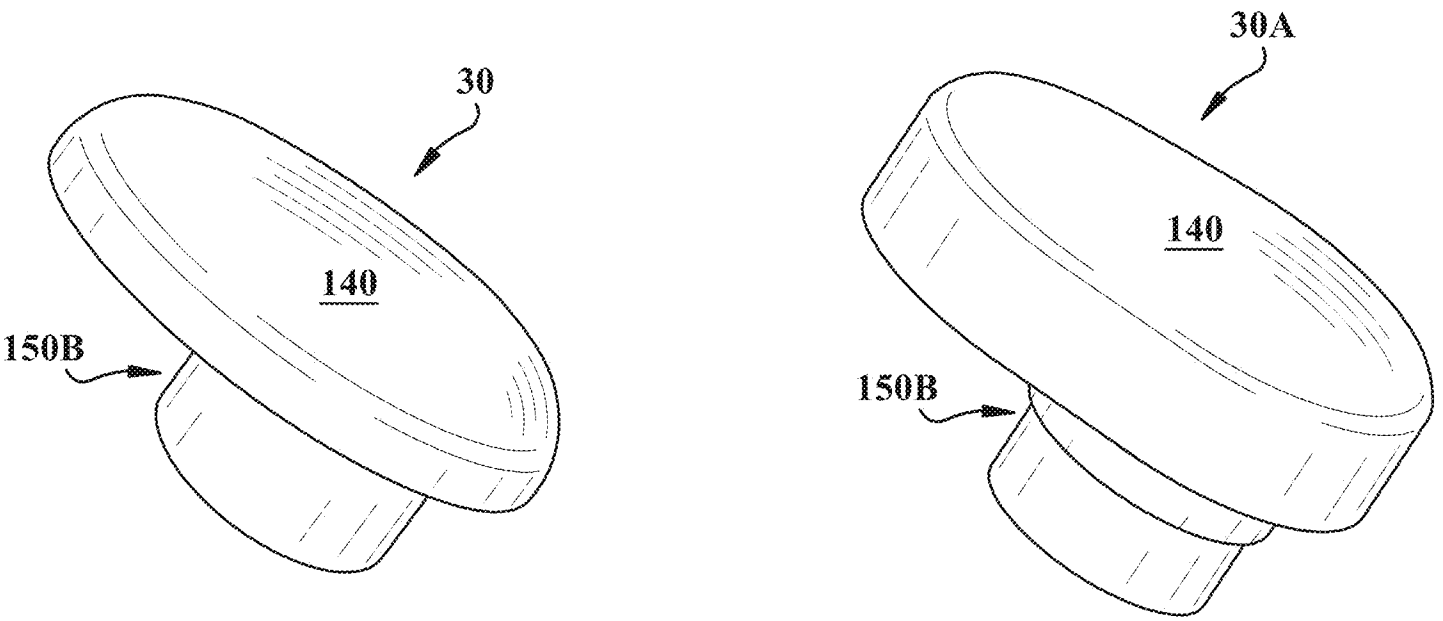
FIG. 9 shows distinct caps for an audio device according to various implementations.

FIG. 9 is a perspective view of the cap 30 described with reference to FIGS. 1, 2, and 4, along with an additional cap 30A. In various implementations, the additional cap 30A can include components similarly described with respect to cap 30, e.g., an antenna 90, battery 100 and terminals 110 (FIG. 4). In various implementations, the additional cap 30A is configured to provide power to the audio device 10 while the first cap 30 is not in use, e.g., while the first cap 30 is being stored and/or is recharging.

In some cases, the additional cap 30A can include additional electronics 220 and/or contacts 240 that are described with reference to certain embodiments of the cap 30 (FIG. 4). In other cases, the additional cap 30A can be substantially identical in type to the first cap 30, e.g., having an approximately equal battery capacity (where "approximately" is defined as equal +/− a degree of measurement error or nominal variation such as a few percent). In still further implementations, the additional cap 30A can have distinct visual characteristics from the first cap 30, e.g., a distinct color or ornamentation. In such cases, a user may wish to install a cap 30, 30A that has desirable and/or distinctive visual characteristics.

In certain cases, the additional cap 30A is configured to couple with the base 20 in the same manner as the first cap 30, such that only one of the caps 30, 30A can couple to a base 20 at a given time. In particular implementations, the caps 30, 30A are directionally indifferent, such that a cap 30, 30A can be configured to couple with both a left and a right earbud 15 or other headphone (e.g., as shown in FIG. 1).

In still other cases, the additional cap 30A can include a battery 100 that has a distinct capacity from the battery 100 in cap 30 (FIG. 4). In certain cases, the additional cap 30A has a larger or otherwise higher-capacity battery 100 as compared with the battery 100 in the cap 30, providing for longer life. In these cases, the larger additional cap 30A is compatible with the base 20 (e.g., in FIGS. 1 and 2) just as the first cap 20 is compatible with that base 20. This enables a user to exchange one cap for another when charge is low and/or distinct storage capacity is desirable.

Figure 10:
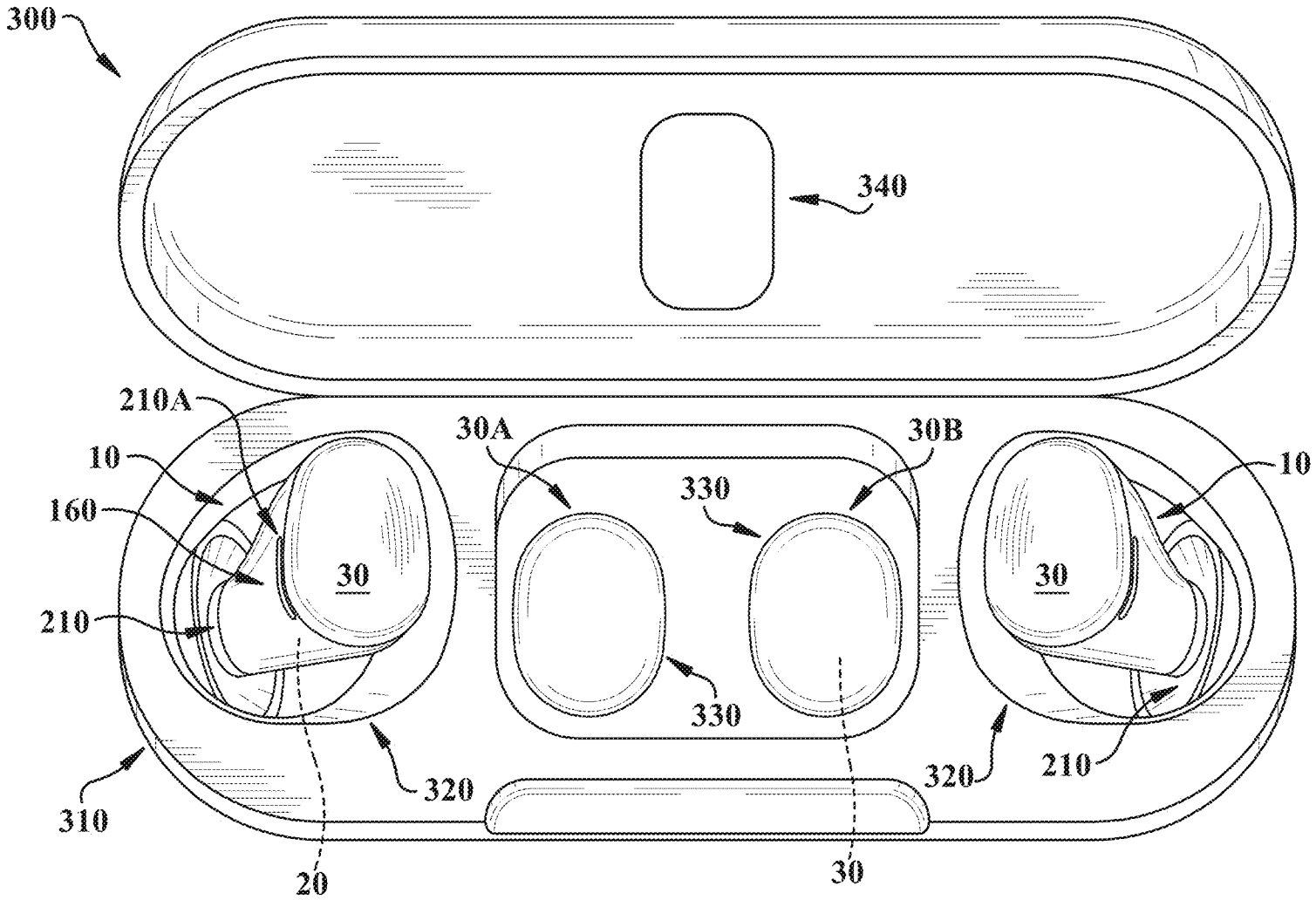
FIG. 10 shows a system including a storage case and an audio device according to various implementations.

FIG. 10 shows a system 300, including a storage case 310 along with the audio device 10 (e.g., earbuds 15) and additional caps 30 according to various implementations. In some cases, the caps 30A, 30B are configured to fit in the storage case 310. In this depiction, the system 300 is shown including the audio device 10 placed in the storage case 310 along with additional caps 30A, 30B. In some cases, the additional caps 30A, 30B can include replacement caps of the same, or distinct type as the caps 30 coupled with the bases 20 in the audio device 10. In various implementations, the caps 30 are sized to fit in the storage case 310 with the base 20. That is, the storage case 310 can include a first set of slots 320 for accommodating the base 20 while coupled with a cap (e.g., the cap 30 or the additional cap 30A, FIG. 9), and a second set of slots 330 for accommodating at least one cap 30 not coupled with the base 20. In the specific implementation depicted in FIG. 10, the storage case 310 includes two slots 320 for storing the audio device 10 and two slots 330 for storing the separate caps 30.

In various implementations, the storage case 310 includes a charging case with a power source for charging the audio device 10 when the base 20 and cap 30 are coupled, as well as charging the additional cap(s) 30. The power source can include a portable power source such as a rechargeable battery and/or an external power connector. In certain implementations, the storage case 310 includes additional electronics such as any of the electronics 40, 50 described with reference to the audio device 10 in FIG. 4. For example, the storage case 310 can include additional electronics such as a user interface, audio transducer, microphone and/or communications devices (e.g., a radio). In still further implementations, the storage case 310 includes a tool 340 for coupling and/or decoupling the cap(s) 30 from each base 20. For example, the tool 340 can include a slot sized to engage the decoupling feature 160 between the base 20 and the cap 30, enabling the user to easily separate the cap from the base 20. In still further implementations, the tool 340 can include a recess sized to receive the cap 30 and enabling coupling of the cap 30 to the base 20. The tool 340 is shown on an inner surface of the storage case 310 in the example depiction in FIG. 10, however, it is understood that the tool 340 can be located in any position on or in the storage case 310.

Figure 11:
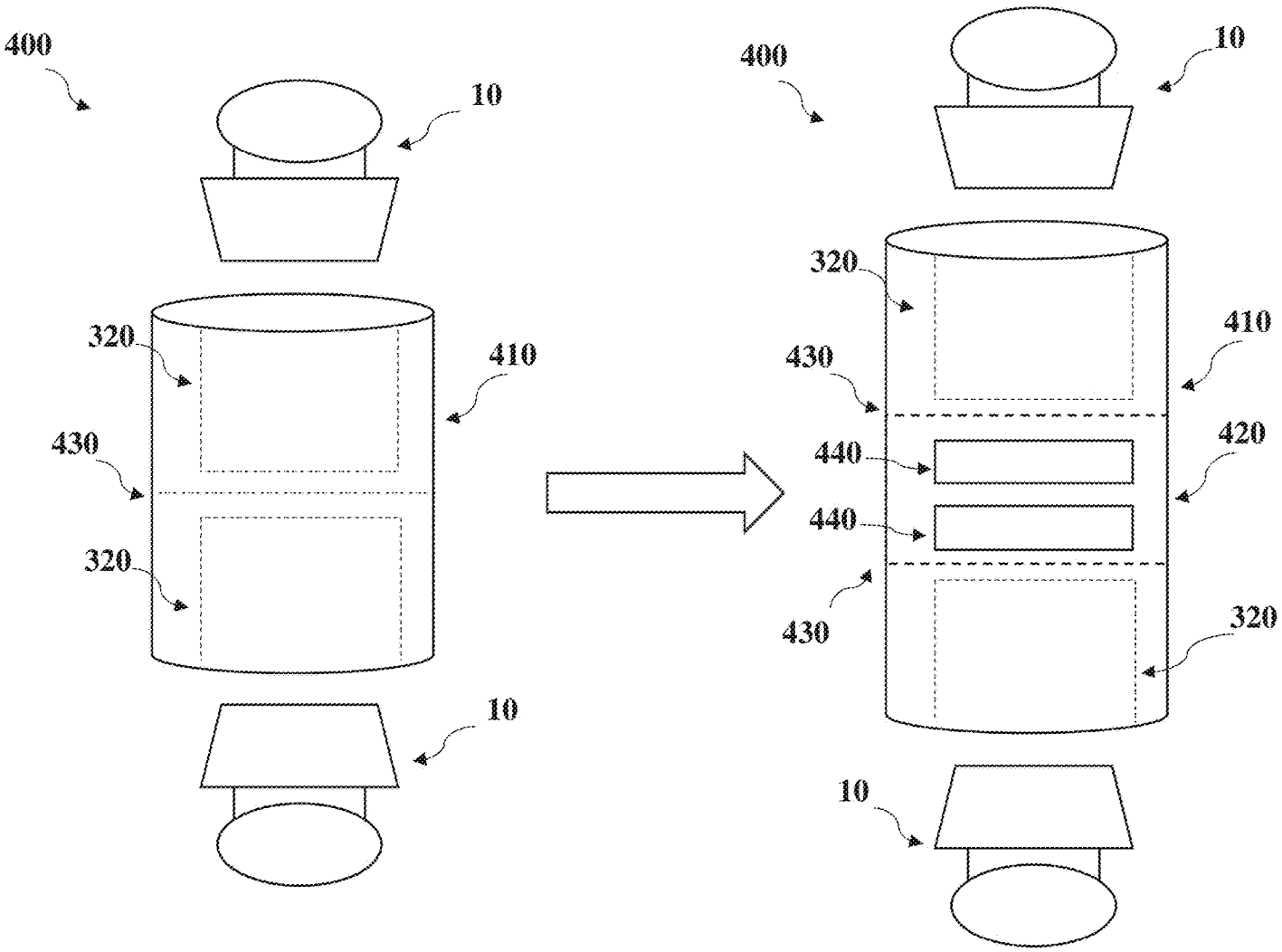
FIG. 11 shows a system including a storage case and an audio device according to various additional implementations.

FIG. 11 shows another example of a system 400, including a storage case 410 with slots 320 for storing, and in some cases, charging the combined base 20 and cap 30. In a first implementation, shown on the left-hand side of FIG. 11, the system 400 includes two (e.g., internal) slots 320 for charging a pair of earbuds (shown as audio devices 10). In additional implementations, the storage case 410 is modular, and includes a supplemental charging case 420 that is removably coupled with the storage/charging case 410. The supplemental charging case 420 can be coupled with the storage case 410 at an interface 430, which in this example, is located between the two slots 320. However, in other implementations, the supplemental charging case 420 is coupled to the storage case 410 on a side or other inner or outer surface. The supplemental charging case 420 can be mechanically coupled with the storage case 410, e.g., via fasteners, interlocking components such as male/female connectors or mating threads. In certain implementations, the supplemental charging case 420 includes at least one additional slot 440 for charging a decoupled cap 30, and an additional power storage device such as an additional battery and/or connector to external power (not shown).

In any case, the audio devices 10 described herein can enable extended useful life and greater adaptability when compared with conventional audio devices. These audio devices 10 can be particularly beneficial for in-ear audio device form factors, and in those cases where the audio device 10 includes a hearing assistance audio device.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Elements of figures are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawings.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

Other embodiments not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

We claim:

1. A wearable audio device comprising:

a base comprising: an acoustic transducer; a controller coupled with the acoustic transducer; and terminals for connecting a power source; and a first cap comprising: an antenna; and a battery comprising terminals for connecting with the terminals in the base, wherein the antenna in the first cap is located proximate an outermost surface of the first cap such that communications signals with the antenna are substantially unobstructed by the battery, and wherein the first cap is removably coupled to the base.

2. The wearable audio device of claim 1, further comprising:

at least one additional cap comprising: an antenna; and a battery comprising terminals for connecting with the terminals in the base, wherein the at least one additional cap is decoupled from the base, and wherein the base is configured to couple with only one of the first cap or one of the at least one additional cap at a time.

3. The wearable audio device of claim 2, wherein the battery in the at least one additional cap has an approximately equal capacity as the battery in the first cap, or a greater capacity than the battery in the first cap, wherein the first cap and one of the at least one additional cap are sized to fit in a storage case with the base, wherein the storage case comprises: a first set of slots for accommodating the base while coupled with the first cap or the additional cap; and a second set of slots for accommodating the other of the first cap or the additional cap not coupled with the base, wherein the at least one additional cap provides additional power to the wearable audio device while the first cap is not in use.

4. The wearable audio device of claim 1, wherein the base and the first cap are removably coupled by at least one mating feature in addition to connections between the terminals in the base and the terminals in the first cap, wherein the at least one mating feature comprises at least one of: a magnet, a male/female coupler, a force-fit coupler, a threaded coupler or a slot-loaded coupler.

5. The wearable audio device of claim 1, wherein the wearable audio device comprises a set of earbuds, and wherein each earbud comprises the base and the first cap.

6. The wearable audio device of claim 5, wherein the base substantially envelops the first cap such that when coupled to form each earbud, an outer surface of the first cap extends beyond a distal end of the base by less than approximately 10-20 percent of a length of the base as measured from a proximal end of the base.

7. The wearable audio device of claim 5, wherein the set of earbuds comprise a hearing assistance audio device, and wherein the base in at least one of the earbuds comprises a light for differentiating a left earbud from a right earbud in the set of earbuds, wherein the light is further configured to indicate a remaining life in the battery.

8. The wearable audio device of claim 1, wherein the first cap further comprises additional electronics, wherein the base and the first cap each comprise a set of electrical contacts for transmitting data between the additional electronics and the controller, wherein the additional electronics comprise at least one of: a user interface, an environmental sensor, a motion/orientation sensor or a communications module, wherein the user interface comprises a tactile interface, wherein the environmental sensor comprises at least one of: a pressure sensor, a humidity sensor or an air quality sensor, wherein the motion/orientation sensor comprises at least one of: an inertial measurement unit or an optical sensor, and wherein the communications module comprises at least one of: a Bluetooth module, a Bluetooth Low Energy (BLE) module, a near-field magnetic induction (NFMI) module or a cellular module.

9. A system comprising:

a wearable audio device comprising:

a base comprising: an acoustic transducer; a controller coupled with the acoustic transducer; and terminals for connecting a power source;

a first cap comprising: an antenna; and a battery comprising terminals for connecting with the terminals in the base, wherein the first cap is removably coupled to the base;

at least one additional cap comprising: an antenna; and a battery comprising terminals for connecting with the terminals in the base, wherein the at least one additional cap is decoupled from the base, and wherein the base is configured to couple with only one of the first cap or one of the at least one additional cap at a time; and a storage case comprising at least one slot for the accommodating at least one of: the base and the first cap when coupled to one another, or the base and one of the at least one additional cap when coupled to one another.

10. The system of claim 9, wherein the storage case comprises a charging case comprising a power source for charging: the base coupled with the first cap or the additional cap; and the other of the first cap or the additional cap that is decoupled from the base.

11. The system of claim 9, wherein the wearable audio device comprises a set of earbuds, and wherein each earbud comprises the base and the first cap, wherein the storage case comprises a charging case and the at least one slot comprises two slots for charging only the base and a coupled one of the first cap or an additional cap for each earbud.

12. The system of claim 11, further comprising a supplemental charging case that is removably coupled with the charging case, the supplemental charging case comprising:

at least one additional slot for charging a decoupled one of the first cap or the at least one additional cap; and an additional power storage device.

13. The system of claim 9, wherein the storage case comprises a tool for at least one of coupling or decoupling the first cap or the at least one additional cap with the base.

14. The wearable audio device of claim 1, wherein the first cap is replaceable with a second, distinct cap that is configured to removably couple to the base, wherein the base is configured to couple with only one of the first cap or the second, distinct cap at a time.

15. A wearable audio device comprising:

a base comprising: an acoustic transducer; a controller coupled with the acoustic transducer; and terminals for connecting a power source; and a first cap comprising: an antenna; and a battery comprising terminals for connecting with the terminals in the base, wherein the first cap is removably coupled to the base, and wherein a second, distinct cap is configured to couple to the base as a replacement cap while the first cap is decoupled from the base.

16. The wearable audio device of claim 15, wherein the replacement cap comprises an antenna and a battery comprising terminals for connecting with the terminals in the base.

17. A wearable audio device comprising:

a set of earbuds, each earbud having:

a base comprising: an acoustic transducer; a controller coupled with the acoustic transducer; and terminals for connecting a power source; and a first cap comprising: an antenna; and a battery comprising terminals for connecting with the terminals in the base, wherein the first cap is removably coupled to the base, wherein the base substantially envelops the first cap such that when coupled to form each earbud, an outer surface of the first cap extends beyond a distal end of the base by less than approximately 10-20 percent of a length of the base as measured from a proximal end of the base.

18. The wearable audio device of claim 17, wherein the first cap further comprises additional electronics, wherein the base and the first cap each comprise a set of electrical contacts for transmitting data between the additional electronics and the controller.

19. A wearable audio device comprising:

a set of earbuds comprising a hearing assistance audio device, each earbud having:

a base comprising: an acoustic transducer; a controller coupled with the acoustic transducer; and terminals for connecting a power source; and a first cap comprising: an antenna; and a battery comprising terminals for connecting with the terminals in the base, wherein the first cap is removably coupled to the base, wherein the base in at least one of the earbuds comprises a light for differentiating a left earbud from a right earbud in the set of earbuds, wherein the light is further configured to indicate a remaining life in the battery.

20. The wearable audio device of claim 19, wherein the base and the first cap are removably coupled by at least one mating feature in addition to connections between the terminals in the base and the terminals in the first cap.

* * * * *